United States Patent [19]

Chen

[11] Patent Number: 4,936,324

[45] Date of Patent: Jun. 26, 1990

[54] COSMETIC COMPACT

[76] Inventor: Sin-Hsiung Chen, No. 26-1, Lane 737, Chong-Chern N. Rd., Tainan Hsien, Taiwan, R.O.C.

[21] Appl. No.: 305,177

[22] Filed: Feb. 2, 1989

[51] Int. Cl.[5] ..... A45D 33/24

[52] U.S. Cl. ..... 132/294; 132/299

[58] Field of Search ..... 132/294, 297, 299, 298, 132/303, 286

[56] References Cited

U.S. PATENT DOCUMENTS

| | | | |
|---|---|---|---|
| 1,490,484 | 4/1924 | Rosenhaft et al. | 132/294 |
| 1,748,964 | 3/1930 | Wacker | 132/294 |
| 1,774,767 | 9/1930 | Smith | 132/294 |
| 1,796,963 | 3/1931 | Rosenhaft et al. | 132/294 |
| 2,128,737 | 8/1938 | Aronstein | 132/294 |
| 2,808,841 | 10/1957 | Bourdon | 132/297 |
| 4,555,020 | 11/1985 | Campello et al. | 132/294 |

FOREIGN PATENT DOCUMENTS

| | | | |
|---|---|---|---|
| 525964 | 9/1921 | France | 132/297 |

*Primary Examiner*—Gene Mancene
*Assistant Examiner*—Michael Lynch
*Attorney, Agent, or Firm*—Bacon & Thomas

[57] ABSTRACT

A cosmetic compact comprising a receptacle and a cover attached to the receptacle by a hinge member for closing same. The inner space defined by the receptacle and the cover is so arranged to receive vanity cases, stick-like a mirror and especially a perfume sprayer with an operation means and a nozzle outlet exposed through a window formed in a bottom wall of the receptacle or a top wall of the cover. The perfume sprayer can be operated to spray perfume without opening the cover of the cosmetic compact.

4 Claims, 5 Drawing Sheets

COSMETIC COMPACT

BACKGROUND OF THE INVENTION

This invention relates to a cosmetic compact, and particularly to a cosmetic compact containing a perfume sprayer which can be operated to spray perfume without opening a cover of the compact.

A known cosmetic compact is shown in FIG. 1, and comprises a bottom part 10 which constitutes a receptacle and a top part 14 which constitutes a cover. The cover 14 is connected to the receptacle by a hinge member which allows the cover to be folded down over the open top of the receptacle or to be folded back from the open top of the receptacle. Locking members 100, 140 are provided to lock the cover in the closed position.

The receptacle is divided into a plurality of pockets adapted for storing vanity cases 11, cosmetic brush 12, eye shadow pen 13 and the like. This known compact is too limited in functions. To this end, the inventor has attempted to make an improved cosmetic compact to overcome the drawbacks of the known one.

SUMMARY OF THE INVENTION

An object of this invention is to provide a cosmetic compact containing a perfume sprayer or the like which can be operated without opening a cover of the compact.

With the above object in view, this invention provides a cosmetic compact which comprises a receptacle and a cover attached to the receptacle by a hinge member for closing the receptacle. The inner space defined by the receptacle and the cover is so arranged to receive vanity cases, stick-like cosmetics, mirror and a perfume sprayer with an operation means and a nozzle outlet exposed through a window formed in a bottom wall of the receptacle or a top wall of the cover so that the perfume sprayer can be operated to spray perfume without opening the cover of the cosmetic compact.

DETAILED DESCRIPTION OF THE PREFERRED EMBODIMENT

The following is a detailed description of the best presently contemplated embodiment of the invention. This description is not to be taken in a limiting sense, but is made merely for the purpose of illustrating the general principles of the invention.

Figure 1:
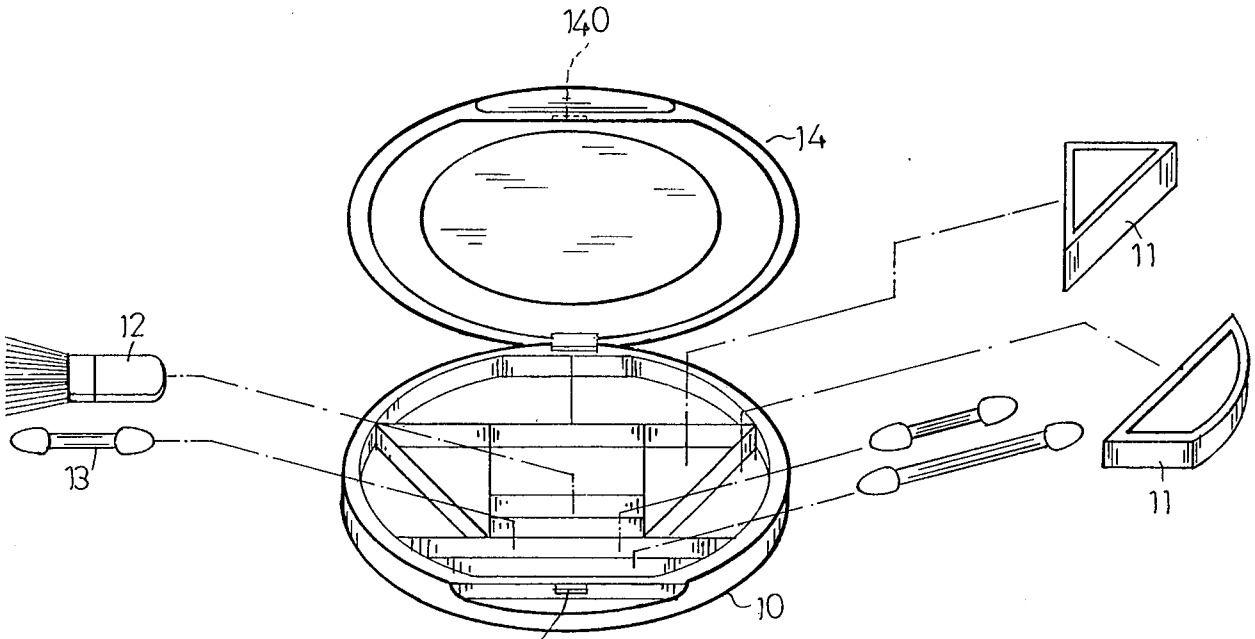
FIG. 1 PRIOR ART
FIG. 1 is a perspective and exploded view illustrating a known cosmetic compact.
Figure 2:
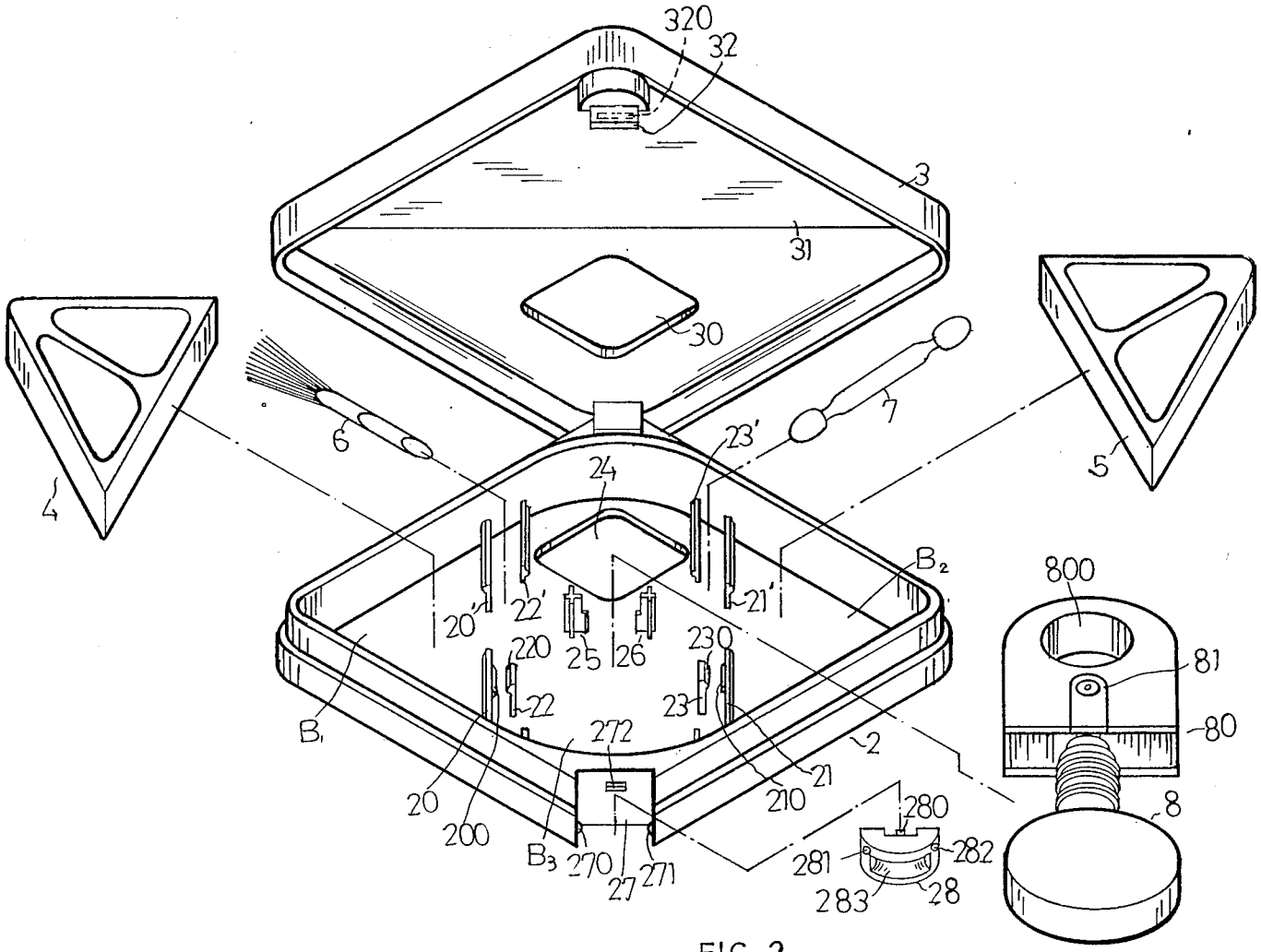
FIG. 2 is a perspective and exploded view of a cosmetic compact showing a preferred embodiment of this invention.
Figure 3:
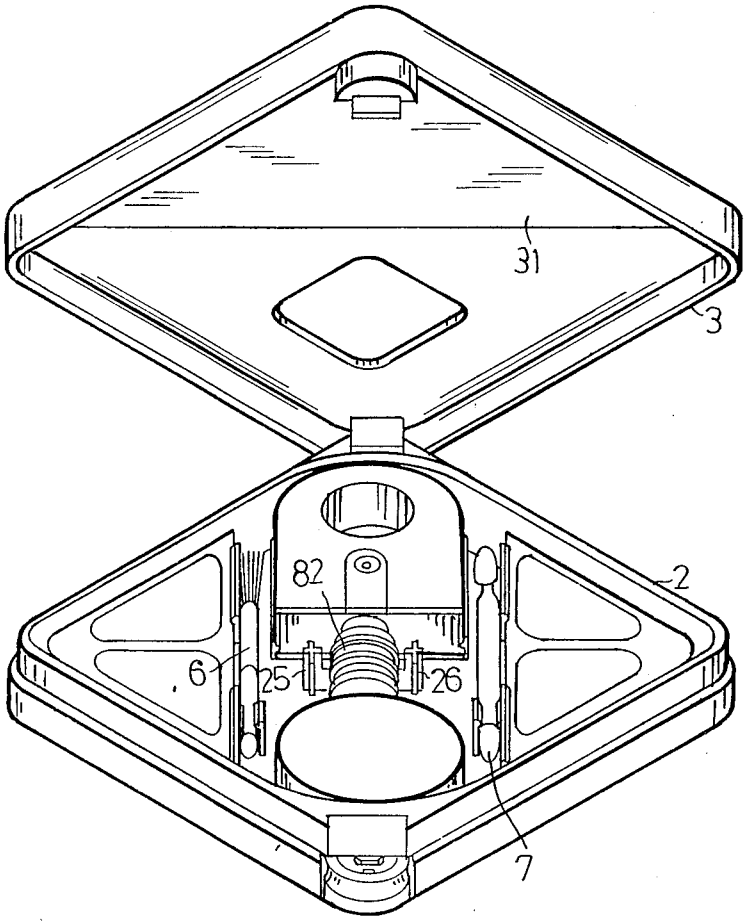
FIG. 3 is a perspective view of the invention shown in FIG. 2 and depicted in assembled condition with its cover opened.

As shown in FIGS. 2 & 3, a cosmetic compact comprises a bottom part 2 which constitutes a receptacle and a top part 3 which constitutes a cover. The structure is of square horizontal configuration and the cover 3 is connected to the receptacle 2 by a hinge member which allows the cover to be folded down over the open top of the receptacle and locked in a closed position by means of locking and release members 28, 32, and also be folded back away from the open top of the receptacle.

A first series of studs 20, 20', 21 and 21' extend upwardly from a bottom wall of the receptacle 2 and define two opposed corner spaces B1, B2 configured for firmly receiving two vanity cases 4, 5. A second series of studs 22, 22', 23 and 23' are respectively opposed to and in pairs with the first series of studs with proper intervals inbetween, defining a diagonal space B3 between said corner spaces B1, B2.

Said studs are provided with lateral projectors 200, 220, 210 and 230 properly shaped for firmly retaining a cosmetic brush 6 and eye shadow pen 7.

A pair of opposed windows 24, 30 are formed in the bottom wall of the receptacle 2 and a top wall of the cover 3 within the diagonal space B3 close to one of the two corners, and a pair of substantially "L" shaped supporters 25, 26 extend upwardly from the bottom wall of the receptacle in a mid portion of the diagonal space B3 forming a groove for supporting a perfume sprayer 8. A mirror 31 is secured to an inner surface of the top wall of the cover 3.

Figure 5:
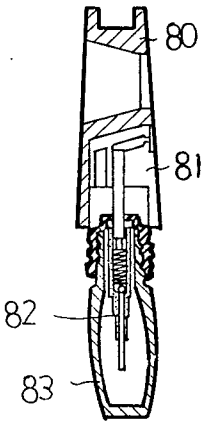
FIG. 5 is a vertical sectional view of the perfume sprayer shown in FIG. 4.
Figure 4:
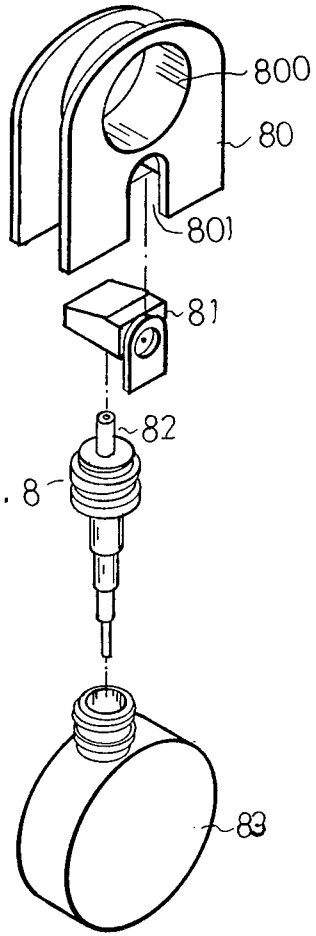
FIG. 4 is a perspective view of a perfume sprayer to be stored in the cosmetic compact of this invention.

Said perfume sprayer 8, as shown in FIGS. 4 & 5, is of the known hand operated type that draws up liquid by means of a pump and mechanically atomizes the liquid. The outer configuration of the sprayer is adapted to be fitted in said diagonal space B3 and operated in reciprocating movement to spray the perfume contained therein without opening the cover 3 of the cosmetic compact. It comprises a perfume container 83, a spray valve mechanism 82 secured to a mouth of the container 83 with a lower portion inserted into the inner space of the container and a section of a conduit protruding upwards therefrom, a nozzle unit 81 secured to the conduit of the spray valve mechanism 82 and connected with the inner space of the container via the mechanism, and an operation frame 80 having a finger hole 800 formed in an upper portion and a tunnel-shaped slot 801 formed in the lower end for slidable engagement with the nozzle unit 81.

When the perfume sprayer is stored in the receptacle 2, as shown in FIG. 3, the spray valve mechanism 82 is supported in the space between the supporters 25, 26 whereas a curved bottom of the container 83 and curved head of the operation frame 80 are respectively fitted in correspondingly configured side walls of the receptacle.

Figure 6:
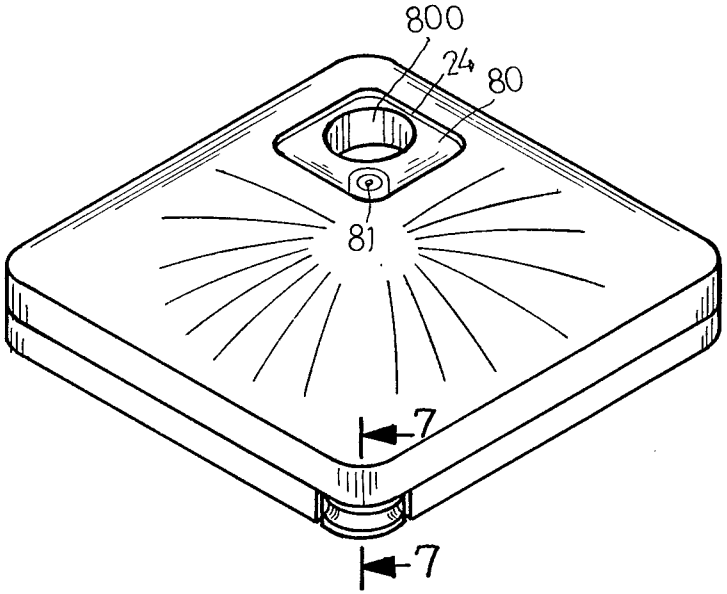
FIG. 6 is a perspective view of the invention shown in FIG. 3 and depicted in closed condition.

In operation, as shown in FIG. 6, the finger hole 800 and the outlet of the nozzle 81 are exposed through the window 24 or 30 of the receptacle or the cover, respectively. Moreover, the sizes of the windows 24, 30 are large enough to always maintain the outlet of the nozzle 81 exposed therethrough whether or not the operation frame is reciprocated to operate same. A cosmetic compact so constructed allows the perfume sprayer to be operated to spray perfume without opening the cover 3 of the compact by inserting a finger in the finger hole 800 of the operation frame 80. The cosmetic compact of this invention still preserves the functions of the known cosmetic compact.

Figure 7:
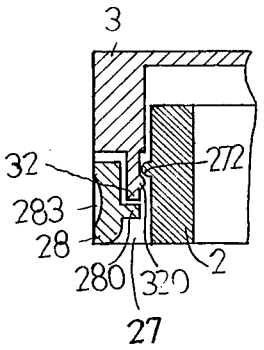
FIG. 7 is a partial sectional view taken along line 7—7 shown in FIG. 6.

The locking and release members 28, 32, as shown in detail in FIGS. 2 & 7, opposed to the hinge member comprises a groove 27 formed in an outer corner of the receptacle 2, having a pair of opposed cylindrical trunnions 270, 271 integrally formed on the opposed inner side walls and a projector 272 formed on the bottom wall thereof, a release unit 28 having a lip 280 projected backwards and located in a groove formed in a rear side wall and extending vertically, a pair of recesses 281, 282 formed in outer side walls and a finger groove 283 extending transversely in an outer wall thereof, hingedly mounted in the groove 27 by fitting the trunnions 270, 271 into the recesses 281, 282, and a plug member 32 having a projector 320 formed on a rear wall and adapted to be engaged with said projector 272, provided under an edge portion of the cover 3 and extending downwardly.

The plug member 32 is inserted into the groove of the release unit 28 as the cover 3 is closed. The cover 3 can be easily opened simply by pressing the finger groove 283 with a finger tip to actuate the lip 280 to release the engaged projectors 272, 320.

While the invention has been described with what is presently considered to be the most practical and preferred embodiment, it is to be understood that the invention is not to be limited to the disclosed embodiment, but on the contrary is intended to cover various modifications and equivalent arrangements included within the spirit and scope of the appended claims, which scope is to be accorded the broadest interpretation so as to encompass all such modifications and equivalent arrangements.

What is claimed is:

1. A cosmetic compact comprising:

(a) a receptacle means including a bottom wall and a side wall;

(b) a cover means including a top wall;

(c) a hinge member attaching the cover means to the receptacle means for permitting the cover means to open and close the receptacle means;

(d) a first series of studs extending upwardly from the bottom wall of the receptacle means and forming first and second opposed spaces in the receptacle means between the first series of studs and adjacent portions of the side wall;

(e) a second series of studs extending upwardly from the bottom wall of the receptacle means and positioned opposite to and forming pairs with the first series of studs, the first and second series of studs defining intervals therebetween, a third space formed between the second series of studs, and the third space being positioned between the first and second spaces;

(f) at least one vanity case receivable in either of the first or second spaces;

(g) at least one cosmetic stick receivable in an interval between the paired first and second series of studs;

(h) support means provided in the midportion of the third space;

(i) a first window means provided in the bottom wall of the receptacle means and a second window means provided in the top wall of the cover means, the first and second window means being positioned in the vicinity of the third space and beyond the location of the support means;

(j) a mirror secured to an inner surface of the top wall of the cover means and spaced from the second window means;

(k) a perfume sprayer device including a perfume container, an operating means and a nozzle outlet, the sprayer device being received within the third space of the receptacle means and supported by the support means, and the operating means and nozzle outlet being positioned at the first and second window means for exposure therethrough when the cover means is in a closed position, thereby permitting a user to actuate the operating means and spray perfume through the nozzle outlet without opening the cover means; and (l) releasable locking means provided in corresponding edges of the receptacle means and the cover means for detachably securing the cover means to the receptacle means, the releasable locking means being positioned opposite to the hinge member.

2. The cosmetic compact of claim 1 wherein the operating means of the perfume sprayer device includes a pump means and a reciprocable operation frame, and a hole provided in the operation frame for engagement by the finger of a user to reciprocate the operation frame.

3. The cosmetic compact of claim 1 wherein the first and second window means are of sufficient size so as to always maintain the nozzle outlet of the sprayer device within the perimeter of at least one window means.

4. The cosmetic compact of claim 1 wherein the releasable locking means includes a groove formed in the receptacle means, a first projector formed on a bottom wall of the groove, a release unit hingedly mounted within the groove and provided with a lip, a plug member carried by the cover means, the plug member including a second projector engageable with the first projector to lock the cover means to the receptacle means, and the release unit being engageable by the finger of the user to actuate the lip for releasing engagement of the first and second projectors.

* * * * *